United States Patent [19]

Mrenna et al.

[11] Patent Number: 4,620,076

[45] Date of Patent: Oct. 28, 1986

[54] CIRCUIT BREAKER APPARATUS WITH LINE TERMINAL SHIELDS

[75] Inventors: Stephen A. Mrenna, Beaver; Gale C. Vosler, South Beaver Township, Beaver County, both of Pa.

[73] Assignee: Westinghouse Electric Corp., Pittsburgh, Pa.

[21] Appl. No.: 716,305

[22] Filed: Mar. 27, 1985

[51] Int. Cl.[4] ..... H01H 13/04; H01H 9/02

[52] U.S. Cl. ..... 200/304; 174/138 F; 200/305; 361/355

[58] Field of Search ..... 361/353, 424, 355; 200/304, 305, 306, 144 C, 148 C; 174/138 F

[56] References Cited

U.S. PATENT DOCUMENTS

| | | | |
|---|---|---|---|
| 3,113,995 | 12/1963 | Spencer | 174/138 F |
| 3,355,685 | 11/1967 | Leonard | 200/306 |
| 3,702,931 | 11/1972 | Jacobsen | 174/138 F |
| 4,266,209 | 5/1981 | Di Marco | 200/304 |
| 4,503,408 | 3/1985 | Mrenna | 335/23 |
| 4,528,531 | 7/1985 | Flick | 335/35 |

*Primary Examiner*—G. P. Tolin

*Attorney, Agent, or Firm*—L. P. Johns

[57] ABSTRACT

A circuit breaker apparatus characterized by a molded case forming a plurality of intercommunicating compartments with a circuit breaker structure within a compartment, arc-quenching means in an adjacent compartment, a line terminal in a next adjacent compartment and electrically insulating shield means between the line terminal and the arc-quenching compartment.

7 Claims, 5 Drawing Figures

CIRCUIT BREAKER APPARATUS WITH LINE TERMINAL SHIELDS

BACKGROUND OF THE INVENTION

1. Field of the Invention

This invention relates to molded case circuit breakers in general and, more particularly, to a circuit breaker having electrically insulating shielding around line terminals in a molded case.

2. Description of the Prior Art

Molded case circuit breaker are designed to provide circuit protection for low voltage distribution systems and to protect connected apparatus against overcurrent conditions. Usually, a circuit breaker is designed to open a circuit automatically on a predetermined overload, without damage to itself when properly applied within its rating.

Inasmuch as tremendous pressures are created by expanded heated air incurred by an arc, air vents are necessary to avoid blowing the molded case apart. However an arc creates ionized air and disperse particles which are electrically conductive and result in flashover of the arc to nearby terminals, thereby causing a phase-to-phase or phase-to-ground failure. For this reason an arc chute is ineffective.

SUMMARY OF THE INVENTION

It has been found in accordance with this invention that not only may such flashovers be avoided, but in addition the rating of the circuit breaker may be increased by providing a circuit breaker apparatus comprising a molded insulated casing having a plurality of walls forming intercommunicating compartments, a circuit breaker structure within one of the compartments and including a contact carrying arm movable between open and closed positions with a cooperating contact, arc quenching means in an adjacent compartment and coextensive with the path of movement of the arm, a terminal in a compartment adjacent to that of the arc quenching means, an electrically insulating shield between the terminal and the arc quenching means for preventing any arc flashover between the terminal and the contact carrying arm, the shield being disposed in the same compartment with the terminal, the terminal including a first side facing the arc quenching means and a second side extending at an angle thereto, and the shield comprising a folded fiber barrier having portions coextensive with the first and second sides of the terminal.

The advantage of the device of this invention is that by reducing the possibility of flashover during short circuit interruption the circuit breaker has an increased short circuit rating.

DESCRIPTION OF THE PREFERRED EMBODIMENT

Figure 1:
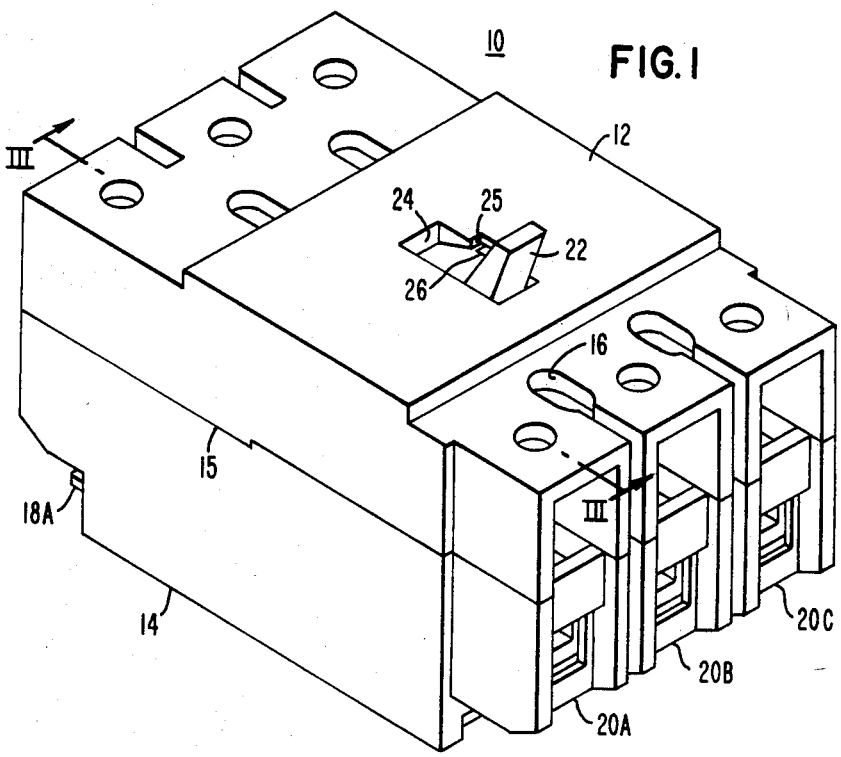
FIG. 1 is a perspective view of a three phase molded case circuit breaker.

In FIG. 1 a three-phase molded case circuit breaker is generally indicated at 10 and it includes an electrically insulatably molded cover 12 which is joined to a similarly molded base 14 at an interface 15. A line terminal 18 (FIG. 3) is provided for the first of three phases, the other of which phases are not shown. Correspondingly, three assembly load terminals 20*a*, 20*b*, and 20*c* for each of the three phases (FIG. 1) shown are provided with terminal 20*a* being related to line terminal 18*a*, and so on.

A handle 22 for manually opening and closing the circuit breaker extends through an opening 24 in the cover 12. An auxiliary opening 25 is provided as an extension of the opening 24 to serve as an opening through which a white indicator, indicia, or spot 26 is exposed when the handle is in a position indicative of the circuit breaker being tripped. The indicator 26 may be stamped onto an arcuate surface of the base of the handle 22. This provides a clear visual indication that the circuit breaker 10 is in the tripped position, because when it is in another position the indicator is concealed under the remaining portion of the front cover 12.

Figure 2:
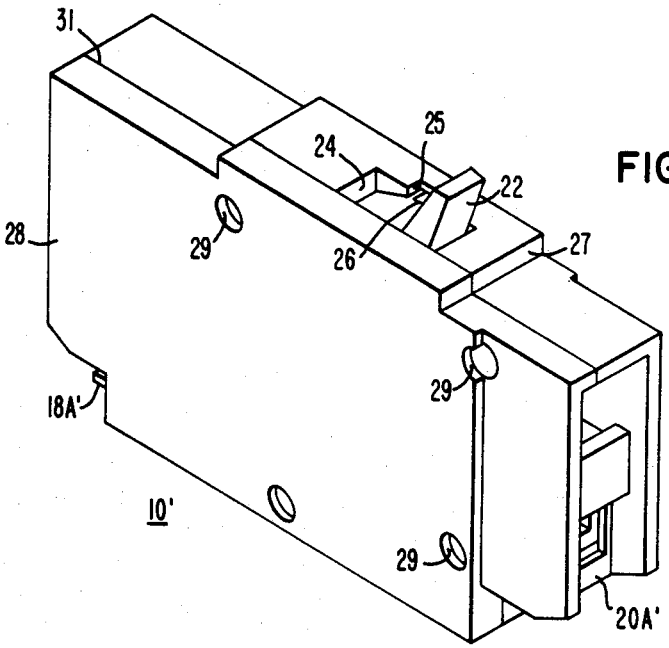
FIG. 2 is a perspective view of a single phase molded case circuit breaker.

A single phase molded case circuit breaker apparatus 10' is generally indicated in FIG. 2 and includes a molded insulating base 27 joined and secured together by rivets 29 at an interface 31. A line terminal (not shown), similar to the terminal 18 (FIG. 3), is provided at the left end of the apparatus 10' and a load terminal or collar assembly 20A', similar to the terminal 20A of FIG. 1, is provided at the right end of the apparatus 10'. Similarly, a handle assembly 22 which is movable in an opening 24 of the cover 28 is provided. An additional extension opening 25 is also provided through which an indicating means 26, similar to the indicating means 26 described with respect to FIG. 1, is evident when the circuit breaker apparatus 10' is in the tripped position.

Figure 3:
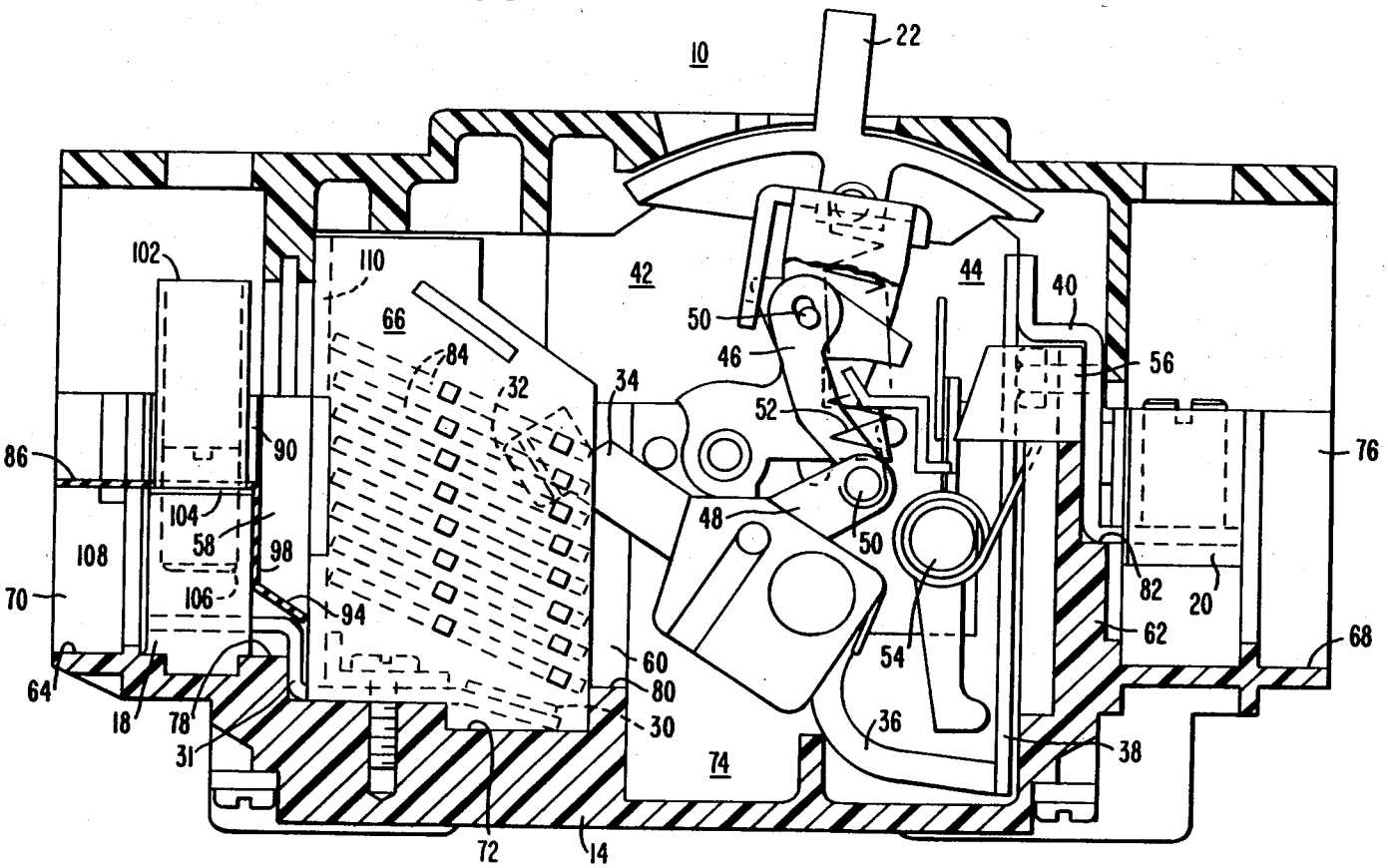
FIG. 3 is a vertical sectional view showing the mechanism in the off position, taken on the line III—III of FIG. 1.

As shown in FIG. 3 a circuit breaker structure is provided within the molded case for interconnection between the line terminal 18 and the load terminal 20. It includes a fixed contact 30 welded on a conductor 31 leading from the line terminal 18. A movable contact 32, mounted on a contact arm 34 is movably operable into and out of electrical continuity with the fixed contact 30 depending upon the status of the circuit breaker structure. The electric circuit through the circuit breaker 10 extends from the line terminal 18 through the conductor 31, the contacts 30, 32, the contact arm 34, a flexible conductor or shunt 36, a bimetal 38 and a conductor 40 to the terminal 20.

The circuit breaker structure includes a support assembly 42 and an operating mechanism 44 which are set forth in detail in pending U.S. Application, Ser. No. 440,681, filed Nov. 10, 1982, entitled Molded Case Circuit Breaker Apparatus Havng Trip Bar With Flexible Armature Interconnection, now U.S. Pat. No. 4,503,408, which is incorporated herein by reference. Generally the operating mechanism includes an overcenter toggle linkage including links 46, 48 which are pivotally connected at pivot pin 50 to which coil springs 52 are connected. The operating mechanism also comprises a trip bar 54 which is actuated either by the bimetal 38, or an electromagnetic 56.

Figure 4:
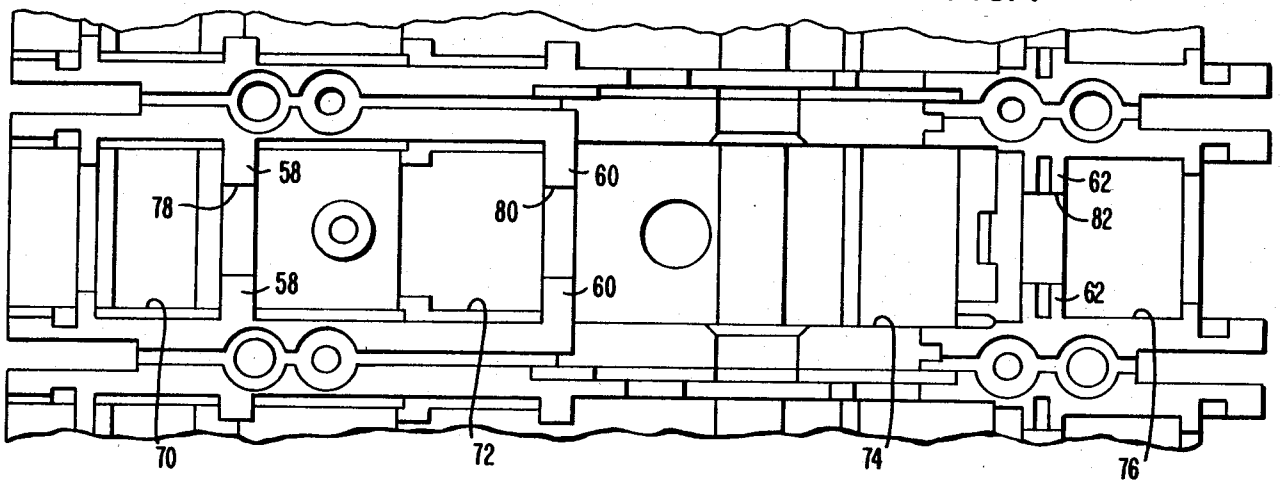
FIG. 4 is a fragmentary, plan view of the base with operating parts deleted.

The base 14 comprises a plurality of spaced partitions 58, 60, 62 extending laterally for dividing each phase chamber into compartments for insuring integrity of isolation between the operating parts of each phase. Thus the terminal 18 is disposed between an access opening 64 (FIGS. 3 and 4) and the partition 58. An arc chute 66 is disposed between the partitions 58, 60. The operating mechanism 44 is located between the partitions 60 and 62. The load terminals 20 are located between the partitions 62 and an end access opening 68. Thus, the several parts 18, 66, 44, and 20 are disposed, respectively, in separate compartments 70, 72, 74, and 76. Manifestly, each partition is provided with intercommunicating openings through which interconnecting parts extend. Thus, the conductor 31 extends through openings 78 in the partition 58, the contact arm 34 extends through an opening 80 in the partition 60, and the conductor 40 extends through an opening 82 in a partition 62.

The arc chute 66 includes a plurality of spaced deionization plates 84 which surround the moving contact 32 as it moves away from the fixed contact 30 in order to extinguish an arc extending therebetween.

Figure 5:
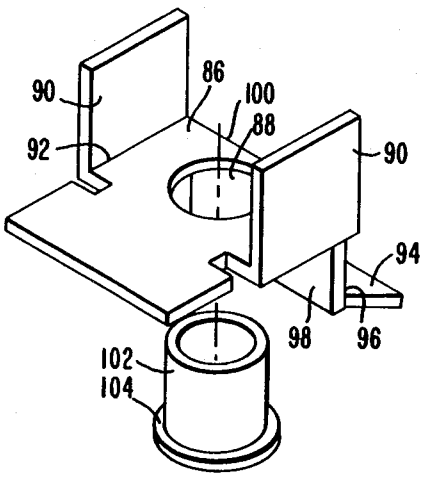
FIG. 5 is an exploded view of the shield in accordance with this invention.

In accordance with this invention, a shield or barrier 86 is disposed in the compartment 70 between the arc chute 66 and the terminal 18. The shield 86 is comprised of an electrically insulating material, such as a fiber composition, and has configuration as shown in FIG. 5 with a central hole 88. The shield 86 includes similar flanges 90 on opposite sides of the pole. Likewise, a flange 94 is provided at the lower end of a down-turn flange 98. The shield also includes a sleeve 102 having an out-turn flange 104 which sleeve when assembled with the shield 86 extends through the hole 88 to surround a screw 106 of a clamp or threaded collar 108 of the terminal 18.

As shown in FIG. 3 the shield 86 is disposed in the compartment 70 above the clamp 108 and with the flange 98 extending downwardly between the clamp 108 and the arc chute 66. The flange 94 is disposed over the conductor 31. The arc chute 66 includes a wall 110 of electrically insulating fiber material which wall is perforated to enable the escape of otherwise explosive gas (air) emitting from the arc chute when the contacts 30, 32 are open. Inasmuch as the gases and other particles incurred during arcing of the opening contacts are conducive to arc flashover between the contact 32 and the screw 106, clamp 108, and contact 30 the shield 86 including the sleeve 102 insulate the assembly of the terminal 18 and conductor 31 from the ionized gases and prevent flashover without eliminating the escape route for the gases through the perforated fiber wall 110.

It is emphasized that inasmuch as the terminal 18 is on the hot or line side of the breaker 10 it is under full potential at all times. The proximity of the arc chute to the terminal 18 creates an undesirable flashover problem which is obviated by the provision of the fibrous shield 86 that covers the assembly of the terminal 18, whereby the terminal is completely insulated.

In conclusion, the shielding of the terminal clamp and screw from the arc blast by a molded insulated sleeve shielding the screw and a folded fiber barrier shielding the collar eliminates the electrical flashover during short circuit interruption, thereby increasing the short circuit rating of the circuit breaker.

What is claimed is:

1. A circuit breaker apparatus comprising:

(a) an electrically insulating housing having side walls forming a compartment and including a terminal within the compartment and between the sidewalls;

(b) a circuit breaker structure within the housing and having a pair of cooperable contacts operable between open and closed positions;

(c) a contact carrying arm for moving one of the contacts and pivotally mounted for movement between said positions; and (d) an electrically insulating shield within the compartment and including a planar portion extending across the compartment and between the sidewalls, the planar portion having a hole through which a portion of the terminal projects, and the electrically insulating shield including a tubular portion extending through the hole and around the terminal.

2. The circuit breaker of claim 1 in which arc-quenching means are disposed adjacent to the path of movement of the contact carrying arm.

3. The circuit breaker of claim 2 in which the planar portion has an upturned flange at each sidewall and has a downturned flange disposed between the terminal and the arc-quenching means.

4. The circuit breaker of claim 3 in which the terminal includes a threaded collar and a screw, and the terminal portion projecting through the hole comprises the screw, and the tubular portion surrounding the screw.

5. A circuit breaker apparatus comprising:

(a) a molded insulating casing having a plurality of walls forming intercommunicating compartments;

(b) a circuit breaker structure within one of the compartments and including a contact carrying arm movable between open and closed positions with a cooperating contact;

(c) arc-quenching means in an adjacent compartment and coextensive with the path of movement of the arm;

(d) a terminal in a compartment adjacent to that of the arc-quenching means; and (e) an electrically insulating shield within the terminal compartment and including a planar portion extending across the terminal compartment with upturned flanges at opposite walls and having a downturned flange between the terminal and the arc-quenching means for preventing any arc flashover between the terminal and the contact carrying arm the electrically insulating shield including a tubular portion extending through a hole in said planar portion.

6. The apparatus of claim 5 in which the terminal includes a first side facing the arc-quenching means and a second side extending at an angle to the first side, and the shield comprising a folded fiber barrier having portions co-extensive with the first and second sides of the terminal.

7. The apparatus of claim 6 in which a terminal screw extends from the second side, and a tubular shield surrounding the screw.

* * * * *